US005101746A

United States Patent [19]

Frye

[11] Patent Number: 5,101,746

[45] Date of Patent: Apr. 7, 1992

[54] WORK HOLDER FOR SEWING MACHINES

[75] Inventor: Ricky J. Frye, Miamisburg, Ohio

[73] Assignee: MIM Industries, Inc., Miamisburg, Ohio

[21] Appl. No.: 583,869

[22] Filed: Sep. 17, 1990

Related U.S. Application Data

[63] Continuation of Ser. No. 232,810, Aug. 16, 1988, which is a continuation of Ser. No. 68,256, Jun. 30, 1987, Pat. No. 4,763,587.

[51] Int. Cl.[5] ..... D05B 21/00

[52] U.S. Cl. ..... 112/121.12; 112/114

[58] Field of Search ..... 112/121.12, 121.15, 112/121.11, 103, 104, 221, 114

[56] References Cited

U.S. PATENT DOCUMENTS

| | | | |
|---|---|---|---|
| 4,280,420 | 7/1981 | Nishida et al. | 112/103 |
| 4,762,076 | 8/1988 | Wakaizumi | 112/103 |
| 4,763,586 | 8/1988 | Takenoya et al. | 112/103 |
| 4,870,917 | 10/1989 | Frye | 112/121.12 |

FOREIGN PATENT DOCUMENTS

| | | | |
|---|---|---|---|
| 61-182791 | 4/1986 | Japan | 112/121.12 |
| 2-114987 | 4/1990 | Japan | 112/103 |

OTHER PUBLICATIONS

Exploded view drawing labeled: PLK-1210.

Three-page document entitled: Mitsubishi Industrial Sewing Machine Workholder Frames.

*Primary Examiner*—Peter Nerbun

*Attorney, Agent, or Firm*—Donald P. Gillette

[57] ABSTRACT

A sewing machine having a clamp frame and a clamp foot is disclosed wherein a quick-release mechanism includes a plurality of guide means which extend parallel to the sewing surface and a holding means bearing against at least one of the guide means holds and releases the clamp frame relative to the clamp foot. The holding means is operable by hand pressure alone, to release the clamp frame from the clamp foot.

27 Claims, 3 Drawing Sheets

WORK HOLDER FOR SEWING MACHINES

This is a continuation of application, Ser. No. 232,810, filed Aug. 16, 1988, which is a continuation of application, Ser. No. 068,256, filed June 30, 1987, now U.S. Pat. No. 4,763,587.

BACKGROUND OF THE INVENTION

This invention relates to a work holder of the type used in sewing machines that form two-dimensional stitch patterns on a series of workpieces, one after another. In particular, the invention relates to a work holder that has easily changeable clamping means that are firmly held in place while being used to clamp a workpiece in place to form a pattern of stitches therein and that remain firmly held in place for as many repetitions of the sewing operation as may be desired but that can be easily removed and replaced by other clamping means to clamp workpieces of a different size.

One of the common repetitive functions in the sewing industry is to sew a label on a panel of material and to repeat that operation over and over as quickly as possible to produce a large number of identical, finished workpieces. The labels are stitched to the larger panel by four rows of stitches formed by moving the panel about on the bed of the sewing machine while the label is held in a fixed position on the panel. In order to do all this as rapidly as possible and to place the stitches exactly where they should be, the movement of the panel is not directly controlled by a human operator. Instead, sewing machines of the type normally used for this purpose, such as the Mitsubishi Model 0303 and Model 0604, have a cloth plate that rests on the bed of the machine and is connected to a mechanism, known as the X-Y mechanism, that moves the cloth plate in a series of incremental steps in two perpendicular directions. These incremental movements are controlled by a digitally programmed electronic controller, which is capable of causing the cloth plate to move not only in a rectangular pattern to set a label but in much more complex patterns to form letters, numbers, or artistic emblems. All of the movement required to form the pattern of stitches is carried out by the cloth plate; the needle moves reciprocatingly in a fixed path that intersects the panel.

The panel of material is clamped against the surface of the cloth plate by a clamp frame that is part of a work holder, which also includes a base and an arm supported by the base. The base is rigidly attached to the cloth plate and to the X-Y mechanism to move in unison therewith according to the stitch pattern to be formed. The arm extends out from the base, and the clamp frame is supported at the free end of the arm. Means are provided to move the clamp frame toward the cloth plate with sufficient firmness to clamp the panel of material against the cloth plate to cause the panel of material to move precisely in unison with the cloth plate according to the recorded stitch pattern.

A typical clamp frame consists of four sides surrounding a rectangular open area of the same size and shape as the label to be sewn to the panel. However, it is not enough merely to place a label in the open area and expect it to lie therein as in the surrounding sides of the clamp frame were a nest; the label must be pressed against the underlying panel of material so that it will remain in a fixed location as the panel moves in accordance with the stitch pattern. Furthermore, as in the sewing of any material, the label must be held down in the region adjacent the needle to prevent tenting. This may be done by means of a hollow cylindrical presser foot that surrounds the needle, or it can be done by a plate that is nearly as large as the open area of the clamp frame and is pressed down against the central part of the label by a separate actuator. This leaves a narrow gap between the perimeter of the plate and the inner perimeter of the frame, and the stitches to sew the label to the underlying panel of material can be formed in that gap.

The plate that presses against the central part of the label is supported by a shaft that extends across the gap and would prevent stitches from being formed directly under it. However, if stitches are to be formed in a closed rectangular pattern, the shaft that supports the plate has an eccentric section directly over the location of the gap, and means are provided to pivot the shaft about 180° to throw the eccentric first to one side and then the other so that stitches can be formed in the region that would be covered by a straight shaft having no eccentric.

One of the problems encountered by the users of pattern stitching machines, especially in attaching labels to panels, is that labels come in different sizes, and each size requires a clamp frame that just fits it. Clamp frames of the type used heretofore have been attached by machine screws to a clamp foot that is moved up and down to release and grip the panel of material onto which the label is to be sewn. When labels of a different size are to be sewn by the machine, the operator, or a mechanic, must unscrew the machine screws, remove the clamp frame, align a different clamp frame with the clamp foot, and reinsert and tighten the screws. During all of that time, the machine is inoperative, and if such changes have to made often, the cumulative down-time can make the resulting sewn products excessively expensive and non-competitive.

OBJECTS AND SUMMARY OF THE INVENTION

It is an object of this invention to provide improved work holding means in which clamp frames can be changed more quickly than heretofore but with no loss of rigidity, accuracy, or holding power of the clamping structure.

Another object is to provide a structure for the work holder that will allow the clamp frame to be changed by the operator without having to use a screwdriver or any other tool to do so.

Further objects will be apparent from the following description and the accompanying drawings.

In accordance with this invention, a first type of interconnectable means is located on the structure that supports the clamp frame, and a second type of interconnectable means is located on each clamp frame to be used with that support structure. The first and second types of interconnectable means must interconnectable firmly but releasably with each other. One type of interconnectable means can comprise a plurality of pins and means to prevent the pins from swiveling relative to each other, as well as from changing the distance by which the pins are spaced apart. The other type of interconnectable means will then comprise a plurality of channels spaced apart by the same distance as the pins and held by structural means so that they are parallel to each other and are spaced apart by exactly the same distance as the pins so that the pins can fit snugly therein. In addition to comprising a plurality of channels, the other type of interconnectable means comprises means to prevent the channels from swiveling.

DETAILED DESCRIPTION OF THE INVENTION

Figure 1:
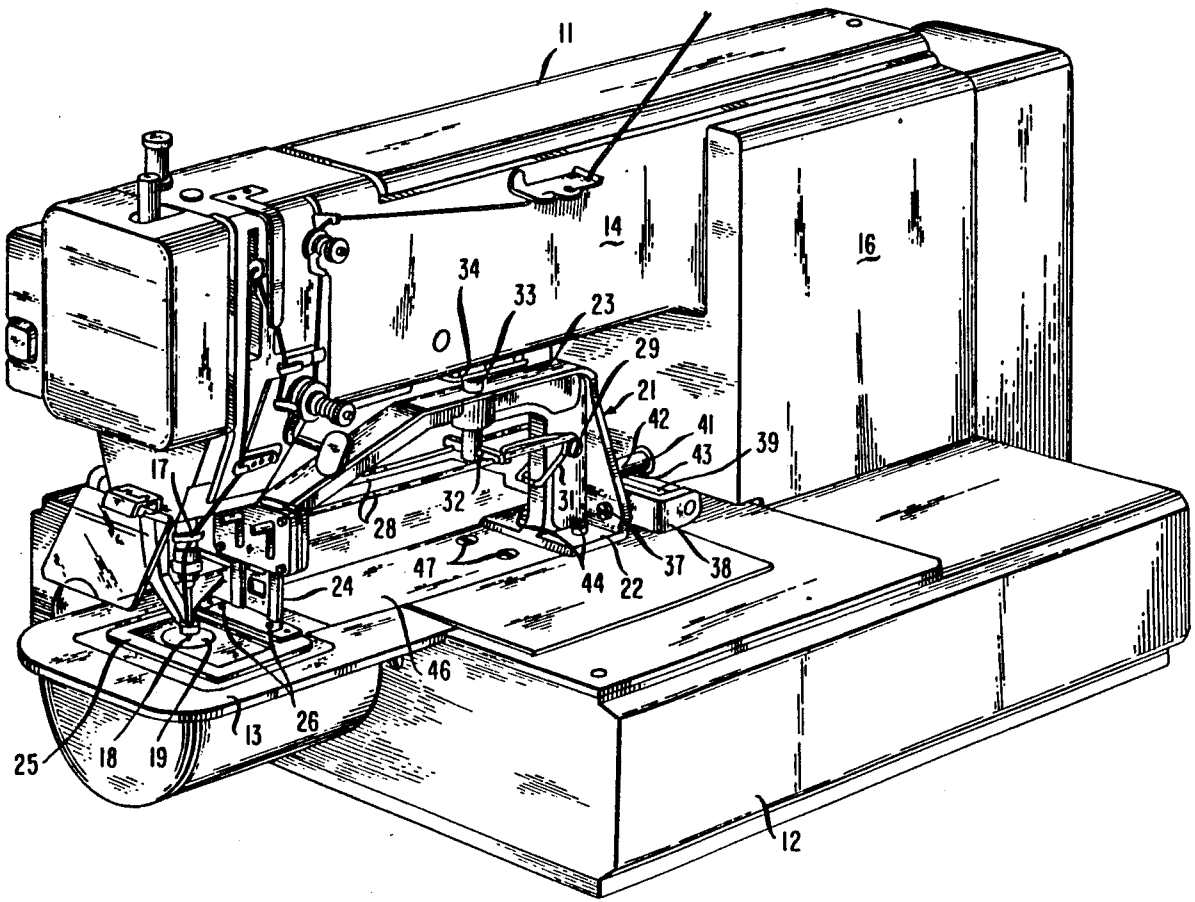
PRIOR ART FIG. 1
FIG. 1 is a perspective view of an existing sewing machine of a type with which this invention is to be used.

FIG. 1 shows one of the sewing machines currently being used to form patterns of stitches under the control of a computer and a stored program. The machine 11, which, in FIG. 1, is a Mitsubishi Model PLK-0604, but which could be any of a number of other pattern-forming machines, includes a base 12 with a sewing surface 13 and a horizontal arm 14 that extends out over the sewing surface, or bed, and is supported by a standard 16. A needle bar 17 near the end of the arm supports a needle 18 for reciprocating motion in a fixed path that is vertical and perpendicular to the sewing surface 13. The needle moves down through a hole in a throat plate 19 at the bottom of its stroke to transfer a loop of thread to a looptaker under the sewing surface. The looptaker is not shown in the drawing but is a typical rotary hook in the Model PLK-0604. The looptaker and needle are part of the stitch-forming mechanism of the machine 11, and both are connected to a main motor (not shown) to be driven by it.

The machine 11 does not have a conventional feed dog. Instead, the workpieces in which stitches are to be formed are held in a work holder 21 that includes a base 22, an arm 23, a clamp foot 24, and a clamp frame 25 attached by machine screws 26 to the clamp foot. A pair of rods 28 mounted on a pivot pin 29 engage the clamp foot 24, as will be more clearly shown in FIGS. 2 and 3, to raise and lower it. These rods are resiliently biased by a spring 31 to urge the rods to their uppermost position. A yoke 32 supported at the lower end of a vertical shaft 33 slidably guided in the arm 23 rests on the rods 28 and is pressed downward by downward movement of a plate 34. The latter, in turn, is controlled by a solenoid (not shown) in the horizontal arm 14 of the machine 11.

The base 22 of the work holder 21 is attached by machine screws 37, only one of which is visible in FIG. 1, to a yoke 38 that supports the ends of a shaft 39. Both the yoke and the shaft 39 extend n a direction defined as the X direction. A coupling shaft 41 has a T-shaped coupling 42 rigidly attached to its forward end, and the cross bar 43 of the coupling 42 fits closely but slidably around the shaft 39 to transmit longitudinal, or Y-directed movements of the coupling shaft 41 to the shaft 39 and the yoke 38 and, thereby, to the work holder 21. Such movements of the coupling shaft 41 may be imparted to it by a stepping motor in the housing 16 by means of an endless belt to which the shaft 41 is clamped and which is driven by the motor. Alternatively, the coupling shaft may be provided with teeth like a rack and driven directly by a pinion mounted on the shaft of the stepping motor. Such a rack-and-pinion drive makes it possible to obtain greater Y-direction movement of the coupling shaft 41, and, thus, of the work holder 21, than can be achieved if the coupling shaft 41 is clamped to a belt driven by the stepping motor.

The base 22 of the work holder is attached by two machine screws 44 to a carriage in the base 12 of the machine, so that Y-directed movement of the work holder is transmitted to the carriage. A cloth plate 46 is connected to the same carriage by two machine screws 47 to move exactly in unison with the work holder 21. The carriage is clamped to a toothed belt looped around two pulleys spaced apart in the X direction in the base of the machine 11, and that belt is driven by a second stepping motor within the base 12. That motor moves the toothed belt and thus the carriage and the work holder and the cloth plate 46, in the X direction. Such movement of the work holder 21 in the X direction does not hinder movement of the work holder in the Y direction due to longitudinal movement of the coupling shaft 41, because the carriage on which the work holder 21 is mounted is constrained by bearings to move the same distance in the Y direction for a given amount of Y-directed movement of the coupling shaft 41 transferred through the T-shaped coupling 42 wherever that coupling happens to be along the shaft 39.

The X and Y dimensions of the plate 34 must at least be equal to the maximum distances that the work holder 21 can move in the X and Y directions so that, no matter where the work holder is located within its X and Y ranges of travel, the shaft 33 will be under the plate 34. As long as that is the case, downward movement of the plate 34 will always push the shaft 33 and the rods 28 downward when the solenoid in the horizontal arm 14 is actuated.

The purpose of moving the rods 28 downward is to force the clamp foot 74 downward against the upward force of the spring 31. The solenoid in the horizontal arm 14 has sufficient force to easily overcome the force of the spring 31 and press the clamp frame 25 down upon any panel of material laid upon the cloth plate 46. The magnitude of such force is easily sufficient to pinch, or grasp, such material forcefully enough to cause the panel of material to move exactly in unison with the movement of the work holder 21 throughout its entire X and Y ranges of action.

Figure 2:
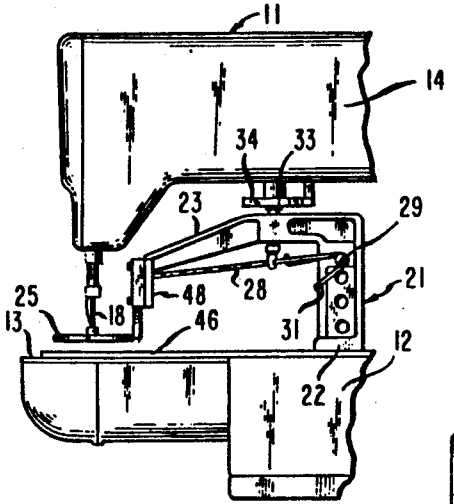
FIG. 2 PRIOR ART
FIG. 2 is a side view of a fragment of the machine in FIG. 1 showing, particularly, one embodiment of a work holder used on that machine.

FIG. 2 shows the clamp foot 24 and the clamp frame 25 in their most elevated position, as they would be to allow a panel of material to be inserted between the clamp frame and the sewing surface 13, or, more precisely, between the clamp fame and the cloth plate 46.

Figure 3:
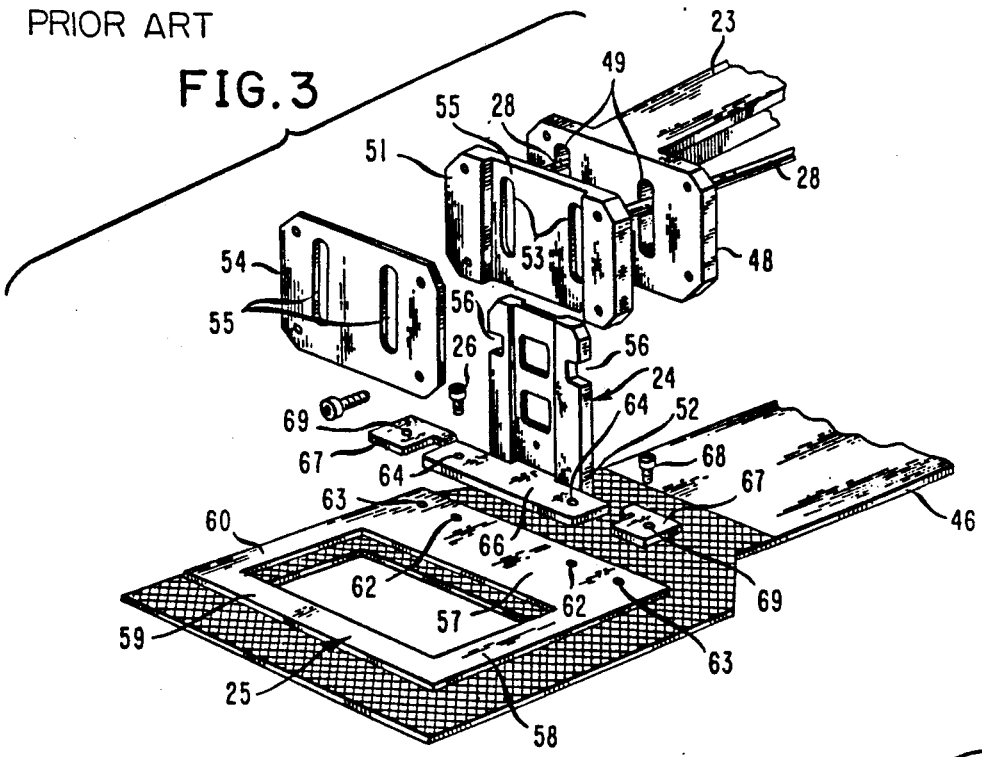
PRIOR ART FIG. 3
FIG. 3 is a perspective, exploded view of a fragment of the work holder in FIG. 2.

FIG. 3 shows more clearly the components associated with the free end of the work holder arm 23 to accommodate up-and-down movement of the clamp frame 25. In this embodiment, the free end of the arm terminates in a vertical plate 48 that has two vertical slots 49 in it through which the rods 28 extend. A work holder guide plate 51 is mounted in surface-to-surface contact with the plate 48 and is provided with a slot just wide enough and deep enough to accommodate the vertical part 52 of the clamp foot 24 and to allow it to slide easily up and down. There are two slots 53 aligned with the slots 49. The rods 28 would normally pass through these slots 53 if the guide plate 51 were in contact with the plate 48, but the exploded location of the plate 51 in FIG. 3 is beyond the ends of the rods. A cover plate 54 is held in surface-to-surface contact with the guide plate 51 to transform the open slot 52 into a closed tunnel to hold the vertical part 52 of the clamp foot in place when the plates 48, 51, and 54 are joined together by machine screws.

The vertical part 52 of the clamp foot 24 has two notches 56 that are spaced apart horizontally the same distance as the slots 49, 53, and 55 and are wide enough vertically to allow the rods 28 to fit therein. Thus, vertical movement of the rods is transmitted to the clamp foot 24.

The clamp frame 25 in this embodiment is shown as a rectangular plate with a rectangular open area surrounded by four sides 57–60. The side 57 has two pairs of threaded holes 62 and 63 in it. The inner holes are aligned with a pair of holes 64 in the horizontal plate 66 at the bottom of the clamp foot 24, and the machine screws 26 through the holes 64 and threaded into the holes 62 hold the clamp frame rigidly attached to the clamp foot. In order to facilitate aligning the clamp frame 25 with the plate 66, two guides 67 are rigidly attached to the side 57 by means of a pair of machine screws 68 that pass through holes 69 in the guides 67 and are threaded into the outer pair of holes 63 in the side 57 of the clamp frame 25. One corner of each of the guides 67 is cut away to fit around a corner of the horizontal plate 66 to make it easier to align the holes 64 with the holes 62 when changing clamp frames. Even so, it is a relatively time-consuming operation to unscrew the screws 26 to remove one clamp frame and then to align another clamp frame, even with the assistance of the guides 67, and, finally, to replace the screws 26.

Figure 4:
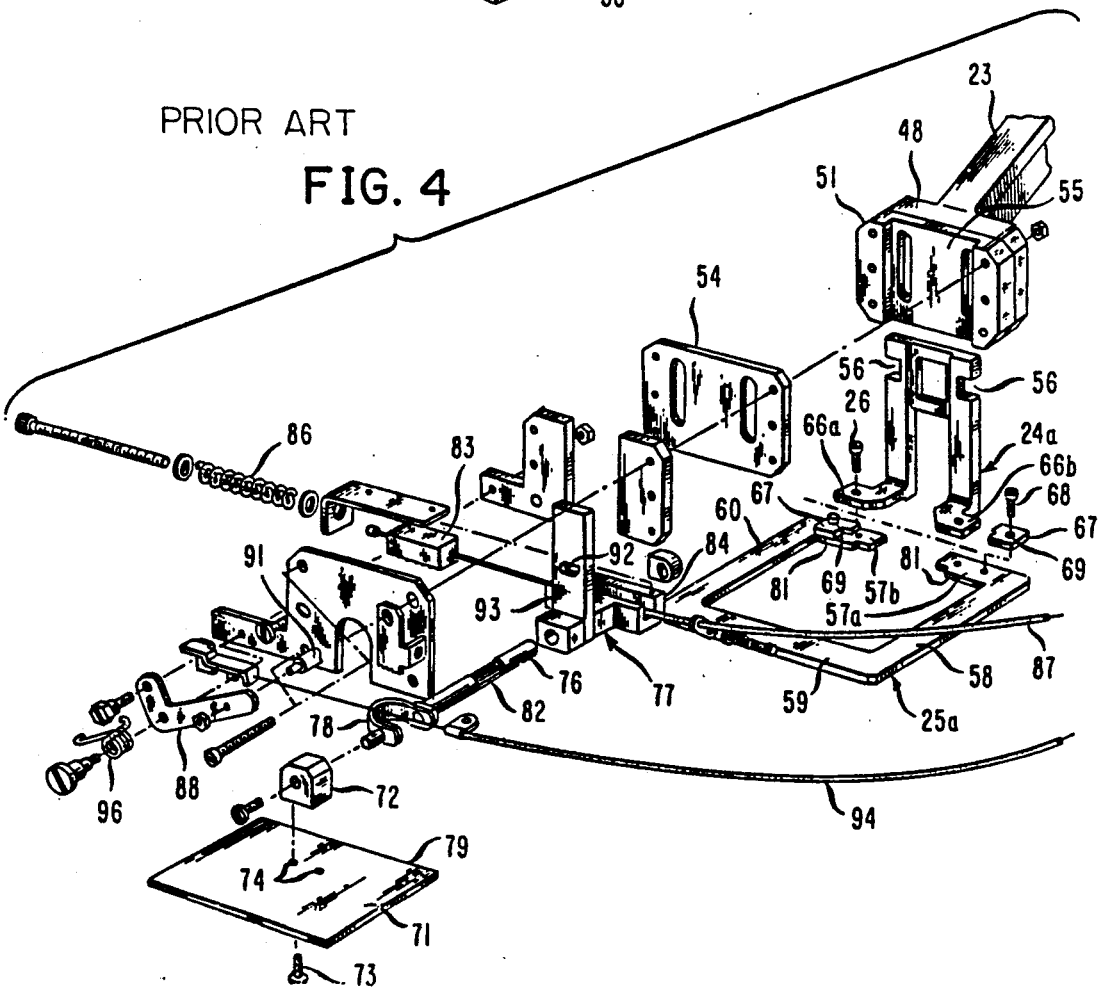
PRIOR ART FIG. 4
FIG. 4 is a perspective, exploded view of a fragment of a different type of work holder currently used with the machine in FIG. 1.

When a completely closed clamp frame such as that shown in FIG. 3 is used, it is possible to form stitches anywhere within the area bounded by the sides 57–60, and this may be done on a single panel of material gripped between the clamp frame 25 and the cloth plate 46 or on a label or other small panel laid within the open area bounded by the sides 57–60. In either case, some means, such as the cylindrical presser foot 20 in FIG. 1 must be used to keep the material from tenting as the needle 18 is withdrawn during the formation of each stitch. When the pattern of stitches is only to be a closed rectangle very close to the perimeter of a rectangular label, a structure such as that shown in FIG. 4 is frequently used. This structure includes a C-shaped clamp frame **25*a* attached to a divided horizontal plate 66*a* at the bottom of a modified clamp foot 24*a*. The same guides 67 are used as were used in the embodiment in FIG. 3 to facilitate aligning the clamp frame 25*a* with the horizontal plate 66*a*. In place of a cylindrical presser foot 20, the embodiment in FIG. 4 includes a plate 71 that nearly fills the open area hounded by the sides 57*a*, 57*b*, and 58–60. The plate 71 is attached to the bottom of a block 72 by machine screws 73 that extend up through holes 74 in the plate 71. The block is pivotally mounted on the end of a swing shaft 76 that is, in turn, pivotally supported in a swing shaft block 77. The shaft 76 has an eccentric 78 that, when the components in FIG. 4 are all assembled, is directly over the gap between the edge 79 of the plate 71 and the edges 81 of the sides 57*a* and 57*b* of the clamp frame 25*a*. The purpose of the eccentric is to keep any part of the perimeter of a label nested in the open are of the clamp frame 25*a* from being permanently hidden from directly above it, as would be the case if there were no eccentric and, instead, the shaft 76 simply extended from the block 72 to the block 77. The shaft 76 has pinion teeth 82 formed in it, and a rack 83 is held within a slot 84 in the block in position so that the teeth of the rack 83 mesh with the pinion teeth 82. The rack is moved to one end of its range of movement by a spring 86 and to the other end by a flexible shaft 87 controlled by a solenoid when the rack 83 is at one end of its range of travel, the eccentric 78 is in the position shown, and when the rack is at the other end of its range of travel, the eccentric is approximately 180° away from the position in which it is shown. Thus, in the first position, one part of the gap between the edges 79 and 81 is covered by the eccentric, but stitches can be formed alongside the entire rest of the perimeter of the plate 71 between that plate and other parts of the edges 81 and between the plate 71 and the sides 58, 59, and 60. Then, when the eccentric is thrown over to its alternative position, the part of the gap. Previously covered by the eccentric will be clear of that obstruction, and stitches can be formed in it, completing an uninterrupted rectangle of stitches around the plate 71**.

The plate 71 can be lifted above the level of the clamp frame **25*a* by a bell crank lever 88 pivotally mounted on a plate 89 rigidly attached to the arm 23. A pin 91 mounted near the end of one arm of the lever 88 engages a slot 92 in a post portion 93 of the block 77, so that when the lever 88 is pivoted counterclockwise by a flexible shaft 94, the block 77 is lifted up. The flexible shaft 94 is actuated by a solenoid (not shown) in order to keep the block 77 properly oriented as it is lifted up and later allowed to move down, primarily in response to the force of a spring 96 that engages one arm of the lever 88 and a projection 97 extending from one side of the plate 89, the post portion 93 is guided between two swing shaft guides 98. These guides are stacked between the cover plate 54 and the plate 89 as part of the stack of plates including the guide plate 51 and the plate 48 at the end of the work holder arm 23**.

Figure 5:
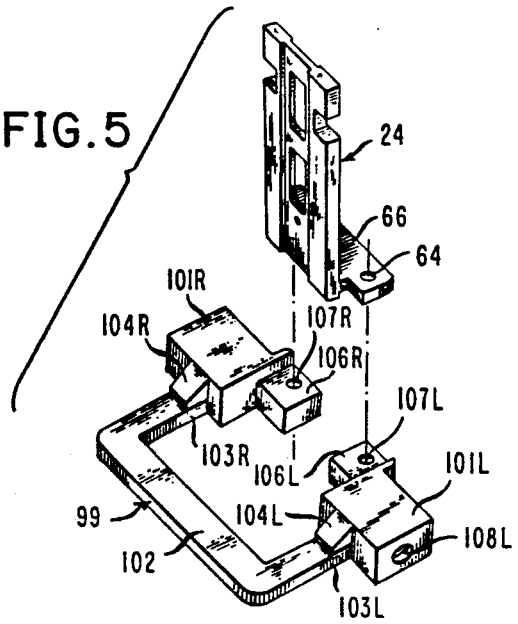
FIG. 5 is a perspective, exploded view of one part of a work holder structure in accordance with this invention.

In accordance with this invention, a structure 99 shown in FIG. 5 is attached to the horizontal plate 66 of the clamp foot 24. This structure includes left and right locating housings 101L and 101R, which are mirror images of each other, and a joining bracket 102 rigidly and permanently joined to the housings. Such rigid connection between these parts may be accomplished by silver-soldering the ends 103L and 103R of the bracket 102 to corners created at the rear surfaces of the housings 101L and 101R by overhanging shelves 104L and 104R extending from the respective rear surfaces. The joining bracket 102 thus serves as means to hold the housings 101L and 101R in absolutely fixed position with relation to one another.

The housings 101L and 101R also have projections 106L and 106R that extend directly toward each other and are bolted to the under surface of the horizontal plate 66 by machine screws that pass through the holes 64 (only one of which is shown in FIG. 5) and enter threaded holes 107L and 107R aligned with the holes 64. Although each housing 101L and 101R is joined to the clamp foot 25 by only a single screw, the fact that the housings are rigidly joined together by the bracket 102 prevents any swiveling of either housing relative to the other or to the clamp foot.

Both of the housings 101L and 101R have threaded holes entering their outwardly facing walls; only the hole 108L is visible in FIG. 5. These holes allow detent means to be inserted into the housings 101L and 101R and to be adjusted after they are inserted.

Figure 6:
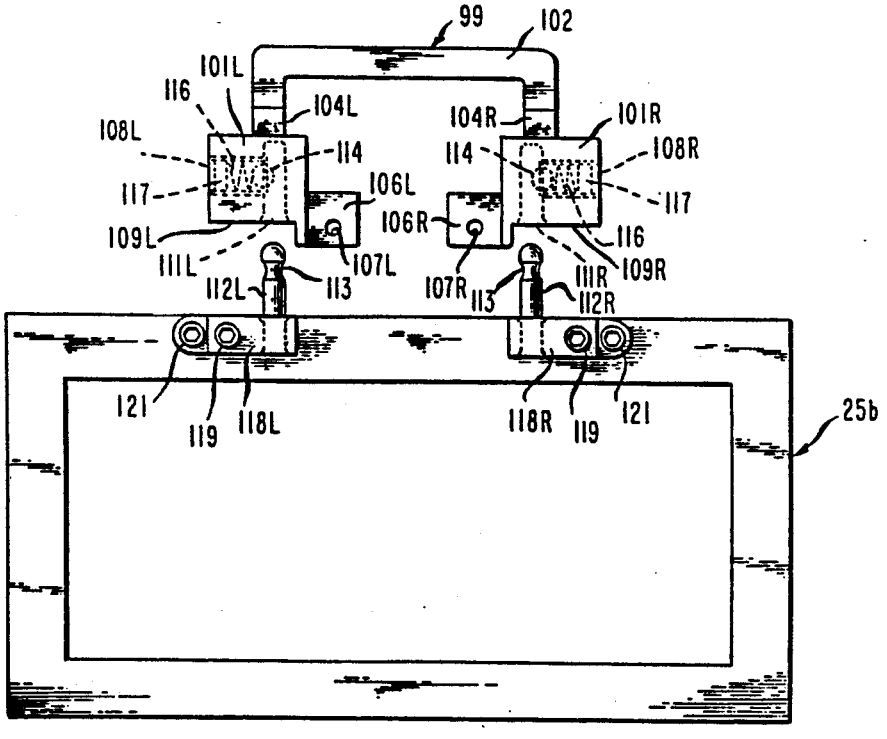
FIGS. 6 and 7 show top and side views of structure in FIG. 5.

FIG. 6 shows a top view of the structure 99 ready for a clamp frame to be attached to it. Each housing has a front surface 101L and 109R, and the bracket 102 holds the housings so that these flat front surfaces are coplanar with each other. Each of the front surfaces is pierced by a hole 111L and 111R, respectively, that extends straight into the respective housing perpendicular to the front surface, so that these holes are parallel to each other. This is essential to permit pins 112L and 112R rigidly attached to the clamp frame 25*b* parallel to each other to be inserted into these holes. The diameter of the pins is just slightly less than that of the holes 111L and 111R, which allows the pins to fit snugly into the holes. In addition, the pins have grooves, or recesses. 113 near their tips to be engaged by holding means such as detent balls 114 within the threaded holes 108L and 108R in the housings 101L and 101R. Springs 116 held in place by set screws 117 exert enough side pressure on the pins to hold them firmly in place once they have been plugged into the holes 111L and 111R. The forces holding the pins 112L and 112R in place prevent any movement of the clamp frame 25*b* when in response to sewing pressures or forces, although the clamp frame and the pins can be removed by the operator using only hand pressure without any tools.

The pins are rigidly mounted in holding blocks 118L and 118R, for example, by being silver-soldered in holes in the blocks. Each of the blocks is attached to the clamp frame 25*b* by two cap screws 119 and 121 that are screwed into threaded holes in the clamp frame. The locations of the holes for the screws 119 and 121 in both the blocks 118L and 118R and the clamp frame 25*b* is such that the pins 112L and 112R will be exactly aligned with the holes 111L and 111R in the housings 101L and 101R. Furthermore, the fact that each block 118L and 118R is attached to the clamp frame by two screws prevents and swiveling of either block and its pin relative to the other block and its pin or relative to the clamp frame.

Figure 7:
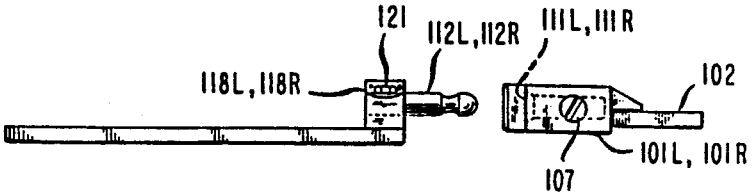

FIG. 7 is a side view showing the clamp frame 25*b* positioned so that its pins 112L and 112R are directly in line with tho holes 111L and 111R in the housings 101L and 101R attached to the clamp foot.

Figure 8:
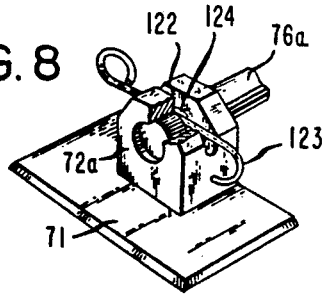
FIG. 8 is a perspective view of a modification of FIG. 4.
Figure 9:
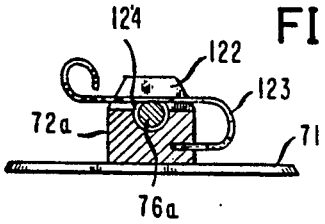
FIG. 9 is a cross-sectional view of the apparatus in FIG. 8.

FIGS. 8 and 9 show a modification of the block 72 on the plate 71 and of the shaft 76 in FIG. 4 to incorporate features of this invention. The block 72*a* in FIGS. 8 and 9 is just like the block 72 in FIG. 4 except that there is a slot 122 in the block 72*a* and a resilient wire 123 extending from one side of the block 72*a* directly below the slot and curled back to pass through the slot. The wire is a tight press fit in a hole in the block 72*a*. The shaft 76*a* has n groove 124 into which the wire presses within the block 72*a*. Unlike the shaft 76 in FIG. 4, which is retained in the block 72 by a screw in the end of the shaft, the only thing that holds the block 72*a* and the shaft 76*a* together is the interengagement of the wire 123 with the slot 122 in the block and with the groove 124 in the shaft. In order to remove the plate 71, all that need be done is to lift the end 126 of the wire 123, which has a curl for safely in handling it, and slide the block 72*a* off of the shaft 76*a*. As may be seen, the depth of the groove 124 is greater than half the diameter of the wire and, in fact, is greater than the diameter. It is necessary of course, that the location of the groove 124 along the shaft 76*a* and the location of the slot 122 in the block 72*a* be so related that the edges of the plate 71 in FIGS. 8 and 9 will be spaced from the edges defining the open area in a clamp frame similar to the frame 25*a* in FIG. 4.

In FIG. 5, which illustrates features of this invention, the housings 101L and 101R are joined to the bracket 102 in such n position that the mounting holes 107L and 107R are spaced apart by exactly the same distance as the holes 64 in the horizontal plate 66. Thus, it is not necessary to modify the clamp foot 24 to make use of this invention. The same is true of the embodiment in FIG. 4, which shows a modified clamp foot 24*a* that has a horizontal plate divided into two parts 66*a*; the mounting holes in those two parts are spaced the same distance apart as the holes 64 in FIG. 3. Since the two housings 101L and 101R are spaced apart, the structure 99 in FIG. 5 can be directly attached to the two-part horizontal plate 66*a* in FIG. 4 without any modification of the clamp foot 24*a*. Thus, in order to make use of the plate 71 with the slotted block 72*a* on it, is shown in FIGS. 8 and 9, all that is necessary is to attach the blocks 118L and 118R of FIGS. 6 and 7 to a C-shaped clamp plate like the plate 25*a* in FIG. 4. The blocks 118L and 118R would require different mounting hole locations in the clamp frame than are used in the clamp frame 25*a* in FIG. 4, but other dimensions of the clamp frame could remain the same as if that frame were to be used in the apparatus in FIG. 4.

While the components shown in FIGS. 3 and 4 are similar to those used by Mitsubishi, the invention is not limited to Mitsubishi machines and especially not to just certain models of pattern-forming machines. Other models and machines manufactured by other companies can benefit equally well from the quick-change structures defined by the following claims.

What is claimed is:

1. In a sewing machine comprising a sewing surface on which workpieces are to be placed one after another to have a pattern of stitches formed in each workpiece, work holder means, clamping means movable toward and away from the sewing surface to engage and release each workpiece whereby such workpiece remains in a fixed position relative to the clamping means while so engaged, positioning means connected to the work holder means to move the work holder means and the clamping means and the engaged workpiece about on the sewing surface according to the pattern of stitches, a needle reciprocatingly movable in a fixed path intersecting the engaged workpiece to form the stitches in the engaged workpiece as the latter is moved about according to the pattern, a quick-change structure comprising:

(a) first interconnectable means precisely positioned relative to the work holder means and rigidly joined thereto;

(b) second interconnectable means precisely positioned relative to the clamping means and rigidly joined thereto, one of the interconnectable means comprising first and second elongated guide surfaces spaced laterally apart by a predetermined distance, and the other interconnectable means comprising third and fourth elongated guide surface spaced laterally apart by the predetermined distance and shaped to interconnect with the first and second guide surfaces, respectively, only by longitudinal movement of one of the interconnectable means relative to the other, and to interfit snugly therewith against lateral movement in any direction relative thereto to position the clamping means precisely and rigidly relative to the work holder means; and (c) holding means on at least one of the interconnectable means and operable in response to hand pressure, alone, to engage the other of the interconnectable means to hold the first and second interconnectable means in predetermined, fixed relationship to each other, whereby the clamping means and the work holder means move as a rigid unit while they are so joined, the holding means also being operable by hand pressure, alone, to release the first and second interconnectable means from each other.

2. The sewing machine as defined in claim 1 in which the first and second interconnectable means comprise first and second projection means and first and second hole means into which the projection means enter only longitudinally and within which the projection means fit snugly.

3. The sewing machine as defined in claim 2 in which the holding means enter the hole means to engage projection means therein.

4. The sewing machine as defined in claim 3 in which the holding means comprise spring-loaded detent means to engage the projection means.

5. The sewing machine as defined in claim 2 in which:

(a) one of the interconnectable means comprises a plurality of parallel projections spaced laterally apart by said predetermined distance; and (b) the other interconnectable means comprises a corresponding plurality of parallel holes shaped to fit the projections snugly and spaced the same lateral distance apart to receive the projections longitudinally within the holes.

6. The sewing machine as defined in claim 5 in which the projections comprise two round, parallel pins, each pin having a predetermined diameter, and the holes comprise two round, parallel holes, each hole having a diameter just large enough to receive a respective one of the pins snugly by longitudinal insertion of the respective pin therein, the holding means further comprising means effective when the pins are fully inserted in the holes to keep the pins fully inserted.

7. In a sewing machine comprising a sewing surface on which one workpiece after another is to be placed to have a predetermined stitch pattern formed therein, a needle reciprocatingly movable in a path intersecting the sewing surface to form stitches in each workpiece, workpiece clamping means comprising clamp frame means and cloth plate means, work holder means comprising clamp foot means movable in a straight line perpendicularly to the sewing surface, and positioning means connected to the work holder means to move the work holder means relative to the sewing surface and to the path of the needle according to the stitch pattern, a quick-release means operable in response to hand pressure, to guide the clamping means into a predetermined position relative to the work holder means and to hold the clamping means in that position and to separate the clamping means from the work holder means, the quick-release means comprising:

(a) first attachment means rigidly joined to the work holder means and comprising first elongated guide means fixedly positioned relative to the work holder means and comprising first and second parallel, straight surfaces extending in a predetermined direction with respect to the work holder means and spaced laterally apart by a predetermined distance; and (b) second attachment means rigidly joined to the clamping means and comprising second elongated guide means located in a selected position relative to the clamping means and comprising third and fourth parallel, straight surfaces extending in a predetermined direction with respect to the clamping means and spaced laterally apart by the predetermined distance, the first and second attachment means interfitting snugly together only by relative longitudinal movement of the first and second guide means in their respective predetermined directions to achieve a fixed position in which the clamping means are held fixed against lateral movement in any direction relative to the work holder means by engagement of the first elongated guide means along the second elongated guide means; and (c) hand-operable means to hold the second attachment means rigidly but hand-releasably interconnected with the first attachment means in a fixed position determined by the first and second guide means to hold the clamping means rigidly but hand-releasably in the fixed position relative to the work holder means.

8. The hand-operable means as defined in claim 7 in which the first attachment means comprises first locking means and the second attachment means comprises second locking means to interlock with the first locking means to hold the first and second attachment means fixedly but hand-releasably together.

9. The hand-operable means as defined in claim 7 in which one of the elongated guide means comprises a plurality of spaced-apart elongated holes side by side in one of the attachment means, and the other elongated guide means comprises pin means in the form of a plurality of pins extending side by side from the other attachment means, each of the pin means being shaped and spaced apart to be inserted only longitudinally in a respective one of the elongated holes and to fit snugly therein.

10. The hand-operable means as defined in claim 9 in which the holes are parallel to each other, and the pins are also parallel to each other.

11. The hand-operable means as defined in claim 10 in which the holes and the pins are straight and parallel to the sewing surface.

12. In a sewing machine comprising a sewing surface on which one workpiece after another is to be placed to have a predetermined stitch pattern formed therein, a needle reciprocatingly movable in a path intersecting the sewing surface to form stitches in each workpiece, clamp frame means, work holder means comprising clamp foot means movable in a straight line perpendicular to the sewing surface, positioning means connected to the work holder means to move the work holder means relative to the sewing surface and to the path of the needle according to the stitch pattern, a quick-release means operable by hand pressure, alone, to hold the workpiece clamp frame means rigidly in a predetermined position relative to the clamp foot means and to allow the clamp frame means to separate from the clamp foot means, the quick-release means comprising:

(a) housing means rigidly attached to the clamp foot means and comprising straight holes extending parallel to each other into the housing means;

(b) block means rigidly attached to the clamp frame means and comprising straight pin means extending from the block means to fit snugly in respective ones of the straight holes to prevent lateral movement of the housing means relative to the block means in any direction; and (c) engagement means on the housing means and operable in response to hand pressure either to engage or release the pin means.

13. The hand-operable means as defined in claim 12 in which the pin means comprises at least one recess, and the engagement means further comprises:

(a) at least one side hole located in the housing means and intersecting one of the straight holes; and (b) spring-biased detent means in the side hole to engage the recess in the pin means in the one of the straight holes.

14. The hand-operable means as defined in claim 12 in which:

(a) the clamp frame means comprises sides defining an open area bounded by the sides; and (b) the block means is divided into two parts with a gap therebetween, the pin means being rigidly attached to the block means on each side of the gap.

15. The hand-operable means as defined in claim 14 in which the work holder means further comprises:

(a) a swing shaft; and (b) a block rigidly attached to the plate means and having a hole to fit onto the swing shaft, the swing shaft having an annular groove and the block having a slot located to overlie the groove when the block is properly positioned on the swing shaft; and (c) a resilient arm attached to the block and resiliently biased to enter the slot and the groove to hold the block properly positioned on the swing shaft.

16. A sewing machine comprising:

(a) a sewing surface on which workpieces are to be placed, one after another;

(b) a needle reciprocatingly movable to form stitches in each workpiece;

(b) clamp frame means:

(c) work holder means comprising clamp foot means to hold the clamp frame means and to control the clamp frame means to move in a straight path perpendicular to the sewing surface to engage each of the workpieces, in turn;

(d) positioning means connected to the work holder means to move the work holder means about relative to the sewing surface according to a pattern of stitches to be formed in the workpiece;

(e) first guide means fixedly located relative to the clamp foot means and comprising first and second internal guide surfaces extending straight in one longitudinal direction relative to the clamp foot means and spaced a predetermined distance apart in a lateral direction perpendicular to the one direction;

(f) second guide means fixedly located relative to the clamp frame means and comprising third and fourth external guide surfaces extending straight in a first longitudinal direction relative to the clamp frame means and spaced a predetermined distance apart in a lateral direction perpendicular to the first direction, the second guide means being interengageable with the first guide means only by relative movement of the third and fourth external guide surfaces into the first and second internal guide surfaces along their respective longitudinal directions to direct the clamp frame means into a predetermined, fixed position with respect to the clamp foot means and to hold the clamp frame in that fixed position against lateral movement in any direction; and (g) retaining means operable by hand pressure and engaging the first and second guide means to hold the clamp frame means in the predetermined, fixed position against longitudinal movement relative to the clamp foot means until released thereform.

17. The sewing machine as defined in claim 16 in which:

(a) one of the guide means comprises first and second parallel, side-by-side holes; and (b) the other guide means comprises first and second parallel, side-by-side pins shaped and spaced to fit snugly into the first and second holes channels, respectively, to hold the clamp frame means rigidly in only one position relative to the clamp foot means.

18. The sewing machine as defined in claim 16 in which one of the guide means comprises a pair of straight, parallel, cylindrical pins spaced apart side by side, and the other guide means comprises a pair of straight, parallel, cylindrical holes spaced apart by the same distance as the pins, each of the holes having a diameter to receive a respective one of the pins and to hold the received pin snugly.

19. The sewing machine as defined in claim 18 in which the holes and pins are parallel to the sewing surface.

20. A quick-release structure for holding sewing machine clamping means in a predetermined position relative to work holder means capable of moving the clamping means about on the sewing surface of the sewing machine, said quick-release structure comprising:

(a) first guide means located in a fixed position relative to the work holder means and comprising first and second straight, elongated internal guide surfaces extending in one direction relative to the work holder means and laterally spaced a predetermined distance apart in a direction perpendicular to the one direction;

(b) second guide means located in a fixed position relative to the clamping means and comprising third and fourth straight, elongated external guide surfaces extending in a first direction relative to the clamping means and laterally spaced the predetermined distance apart in a direction perpendicular to the first direction and shaped to fit snugly with the first and second guide surfaces, respectively, to guide the clamping means into fixed relation relative to the work holder means in the predetermined position only by longitudinal movement of the second guide means relative to the first guide means and to prevent lateral movement of the second guide means relative to the first guide means in any direction; and (c) retaining means operable by hand pressure, alone, without the use of tools, to bear against at least one of the guide means to retain the clamping means rigidly fixed in the predetermined position relative to the work holder means and, in the opposite direction, to release the clamping means from the work holder means.

21. The quick-release structure of claim 20 in which one of the guide means comprises first and second pins fixedly positioned parallel to each other and spaced apart by a predetermined distance, and the other of the guide means comprises first and second holes fixedly positioned parallel to each other and spaced apart by the predetermined distance to receive the first and second pins and to fit snugly thereabout.

22. The quick-release structure of claim 21 in which the pins are parallel to the sewing surface.

23. The quick-release structure of claim 20 comprising attachment means attached to the work holder means in a specific position relative thereto and comprising the first guide means.

24. The quick-release structure of claim 20 comprising attachment means rigidly attached to the clamping means in a specific position relative thereto and comprising the second guide means.

25. In a sewing machine comprising a sewing surface, a clamp frame, a clamp foot, and work holder means to move the clamp foot about on the sewing surface and comprising guide means to allow the clamp foot to move perpendicularly with respect to the sewing surface, a quick-release means operable to hold the clamp frame rigidly in a predetermined, fixed position relative to the clamp foot to move the clamp frame about and operable to release the clamp frame means, and comprising:

(a) attachment means comprising:

(i) first and second straight, elongated guide means located on the clamp foot in a fixed position and extending parallel to the sewing surface and spaced laterally apart by a predetermined distance, and (ii) third and fourth straight, elongated guide means located in a fixed position on the clamp frame and also extending parallel to the sewing surface and spaced laterally apart by the predetermined distance and shaped to interfit snugly with the first guide means, with one of the guide means comprising pin means within the other guide means to guide the clamp frame along a straight line longitudinally of the guide means into a fixed relation relative to the clamp foot in the predetermined position and to retain the clamp frame fixed against lateral movement in any direction relative to the clamp foot; and (b) holding means bearing against at least one of the guide means to retain the clamp frame in the predetermined position relative to the clamp foot until the holding means is released, said holding means being entirely hand-actuable without the use of tools.

26. The quick-release means of claim 25 in which one of the guide means comprises a pair of straight, parallel round pins of a predetermined diameter and having a certain axis-to-axis spacing, and the other guide means comprises a pair of straight, parallel round holes having the same axis-to-axis spacing, whereby each of the holes is positioned to receive a respective one of the pins, each of the holes having an inner diameter substantially equal to burt slightly larger than the diameter of the respective pin received therein to allow the respective pin to be received snugly therein, the holding means comprising means movable transversely with respect to the holes entirely in response to hand force in one direction to enter the holes to engage the pins therein to retain the pins against movement relative to the holes in any lateral direction, and, alternatively, to move out of engagement with the pins entirely in response to hand force in the opposite direction.

27. The quick-release means of claim 26 in which the first guide means comprises a first housing attached to the clamp frame with the pins extending a predetermined distance from a front surface thereof, and the second guide means comprises a second housing with the holes extending at least said predetermined distance into a front surface thereof to receive the respective pins sufficiently to allow the front surfaces to come into surface-to-surface contact with each other.

* * * * *